US006832939B2

(12) United States Patent
Rose et al.

(10) Patent No.: US 6,832,939 B2
(45) Date of Patent: Dec. 21, 2004

(54) SOLENOID-OPERATED REVERSE HOOK ASSEMBLY FOR AN OUTBOARD MOTOR

(75) Inventors: Dave M. Rose, New Berlin, WI (US); David Schmitz, Reeseville, WI (US); Michael Plutte, Oak Creek, WI (US); Brian Munzel, Port Washington, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/403,737

(22) Filed: Mar. 31, 2003

(65) Prior Publication Data

US 2004/0116008 A1 Jun. 17, 2004

Related U.S. Application Data

(63) Continuation-in-part of application No. 10/318,638, filed on Dec. 13, 2002, now abandoned.

(51) Int. Cl.[7] ..... B63H 5/125
(52) U.S. Cl. ..... 440/61 F
(58) Field of Search ..... 440/61 F

(56) References Cited

U.S. PATENT DOCUMENTS

| | | | | |
|---|---|---|---|---|
| 1,621,747 A | | 3/1927 | Mould | |
| 1,933,481 A | | 10/1933 | Mathias | |
| 3,140,689 A | | 7/1964 | Miner | |
| 3,202,126 A | | 8/1965 | Urbassik | |
| 3,468,282 A | | 9/1969 | Wintercorn | |
| 3,785,328 A | | 1/1974 | Kloiber | |
| 3,785,329 A | | 1/1974 | Shimanckas | |
| 3,935,830 A | | 2/1976 | Cox | |
| 3,991,699 A | | 11/1976 | Bass | |
| 3,999,502 A | | 12/1976 | Mayer | |
| 4,050,359 A | | 9/1977 | Mayer | |
| 4,122,794 A | | 10/1978 | Rossini | |
| 4,318,701 A | * | 3/1982 | Kirkwood et al. | 440/51 |
| 4,480,573 A | | 11/1984 | Barbour | |
| 4,637,800 A | * | 1/1987 | Slattery | 440/56 |
| 4,838,818 A | | 6/1989 | Edwards | |
| 4,864,955 A | | 9/1989 | Bruce | |
| 5,062,375 A | | 11/1991 | Makielski | |
| 5,151,058 A | * | 9/1992 | Tahara et al. | 440/61 R |
| 5,195,483 A | * | 3/1993 | Ishida | 123/198 E |
| 6,009,826 A | | 1/2000 | Nole | |
| 6,092,484 A | | 7/2000 | Babin et al. | |
| 6,129,599 A | | 10/2000 | Hallenstvedt et al. | |

* cited by examiner

*Primary Examiner*—Stephen Avila
(74) *Attorney, Agent, or Firm*—Michael Best & Friedrich LLP

(57) ABSTRACT

A reverse hook assembly that is adapted to attach an outboard motor to a fixed member interconnected to a marine vessel, the reverse hook assembly including a movable hook engageable with the fixed member, a solenoid having a movable plunger, a linkage that selectively moves the hook in response to movement of the plunger, and a switch electrically connecting the solenoid with a power source.

27 Claims, 5 Drawing Sheets

SOLENOID-OPERATED REVERSE HOOK ASSEMBLY FOR AN OUTBOARD MOTOR

RELATED APPLICATIONS

This is a continuation-in-part patent application of U.S. patent application Ser. No. 10/318,638 filed on Dec. 13, 2002, now abandoned, which is incorporated herein by reference.

FIELD OF THE INVENTION

This invention relates to outboard motors.

BACKGROUND OF THE INVENTION

In forward gear, the reaction forces on an outboard motor propeller tend to push the submerged portion of the motor toward the stern of the boat. However, in reverse gear, the reaction forces on the propeller tend to push the submerged portion of the motor away from the stern of the boat. To help prevent this from occurring, some non-rigid mounting brackets utilize a stabilizing link to connect the motor with the boat to make the bracket more rigid.

In some outboards utilizing a non-rigid mounting bracket, a hook is used to connect the motor with the boat before operating the motor in reverse gear. Typically, some kind of mechanical linkage connects to the hook and the transmission shift lever. The linkage is arranged such that when the transmission is engaged in reverse gear, the linkage engages the hook with the crossbar. Similarly, when the transmission is disengaged from reverse gear, the linkage typically disengages the hook from the crossbar.

SUMMARY OF THE INVENTION

The present invention provides a solenoid-operated reverse hook assembly for an outboard motor. One construction of the hook assembly includes a reverse hook assembly that is adapted to attach an outboard motor to a fixed member of a marine vessel, such as a crossbar of a boat, canoe, or raft. The reverse hook assembly includes a movable hook engageable with the crossbar or other fixed member, a solenoid having a movable plunger, a linkage that selectively moves the hook in response to movement of the plunger, and a switch electrically connecting the solenoid with a power source.

Another construction of the hook assembly includes a reverse hook assembly that is adapted to attach an outboard motor to a marine vessel, including a movable hook engageable with the crossbar, a solenoid having a movable plunger, a lever coupled to the plunger, a rod that selectively moves the hook in response to movement of the lever, and a switch electrically connecting the solenoid with a power source.

The present invention also provides a method of actuating a reverse hook assembly for an outboard motor including manipulating a switch to a first position, applying a first voltage to a solenoid to initiate movement of the hook assembly, replacing the first voltage with a second voltage to the solenoid to maintain the hook assembly in an engaged position, the second voltage being less than the first voltage, manipulating the switch to a second position, and removing the second voltage from the solenoid to initiate movement of the hook assembly toward a disengaged position.

Further constructions and features of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

FIGS. 1 through 3*b* illustrate a solenoid-operated reverse hook assembly 10 for an electric outboard motor, or electric outboard 14. It should also be known that the reverse hook assembly 10 is adaptable for use in a conventional, engine-powered outboard if DC power is available from, for example, a battery. In one configuration of the reverse hook assembly 10, the assembly 10 utilizes existing controls of the battery-powered electric outboard 14, in addition to power supplied by the electric outboard's battery (not shown).

Figure 1:
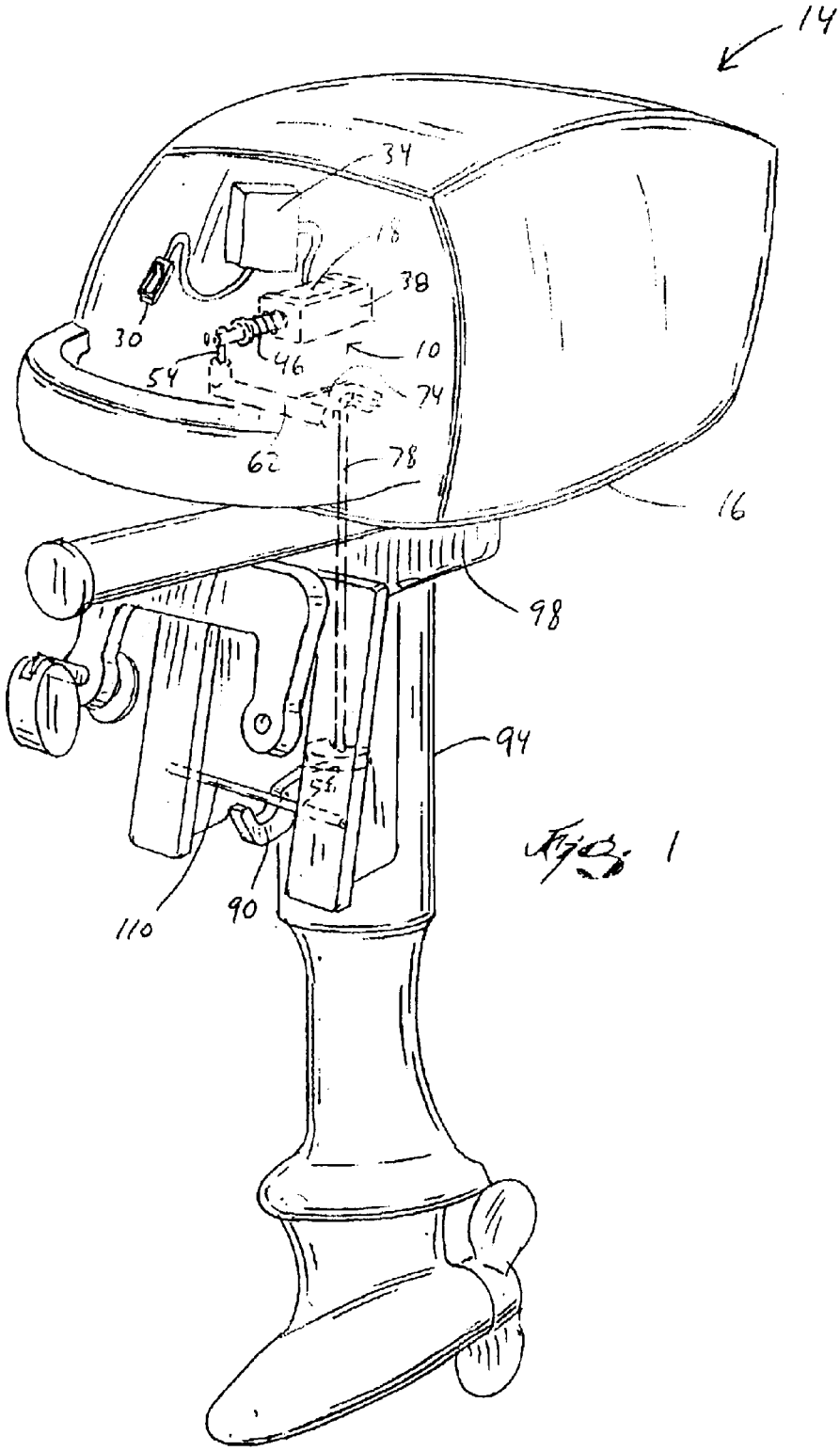
FIG. 1 is a perspective view of an outboard motor including one construction of a solenoid-operated reverse hook assembly embodying the present invention.
Figure 2:
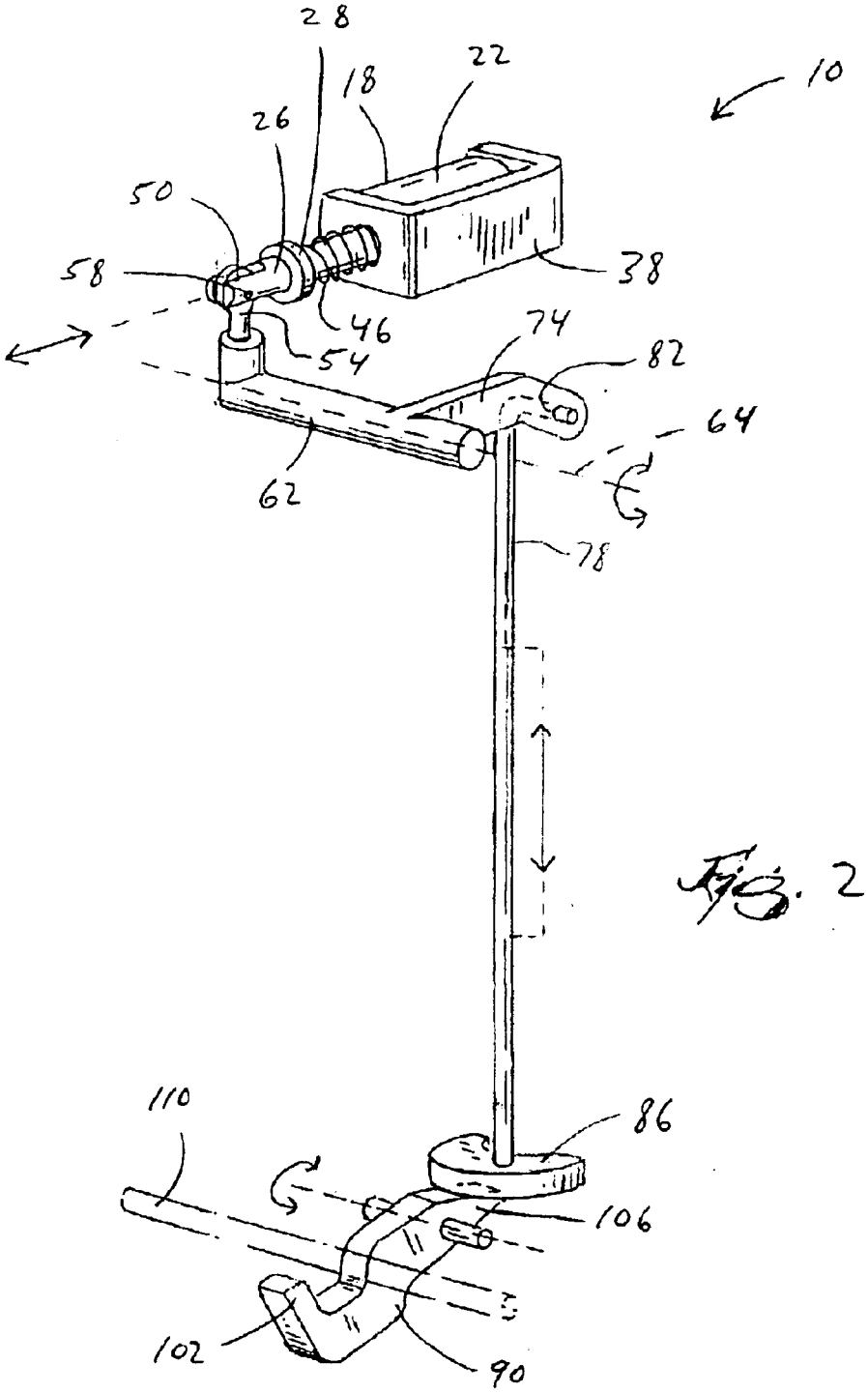
FIG. 2 is a perspective view of the reverse hook assembly of FIG. 1.

As shown in FIG. 1, the reverse hook assembly 10 is positioned within the interior of an outboard housing 16. Although only the reverse hook assembly 10 of FIG. 2 is shown positioned within the interior of the housing 16, other reverse hook assemblies, such as the reverse hook assembly 200 of FIG. 4, may also be positioned within the housing 16. The reverse hook assembly 10 is electrically actuated via a solenoid 18 including a body portion 22 and a plunger 26. The solenoid 18 is a conventional electric solenoid 18 and may include any size and reasonable stroke length. The solenoid 18 may operate at different voltages, such as 24-VDC or 48-VDC, provided the solenoid 18 satisfies the design requirements of the assembly 10. In addition, the solenoid 18 may be energized with a large initial voltage spike, such as 48-VDC, to actuate the plunger 26. The large initial voltage spike may then be followed by a reduced voltage signal, such as 16-VDC, to hold the plunger 26 in its actuated position. An example of such a solenoid 18 is an intermittent-rated 24-VDC solenoid 18, part number 53753-88, made by Deltrol Controls. A multi-position switch 30 is mounted on the outboard 14 to allow a boater to shift between forward, neutral, and reverse gears, for example. The switch 30 is electrically connected with a conventional motor controller 34, such as a motor controller 34 manufactured by Sevcon, Inc. in Boston, Mass. The motor controller 34 operates on a 48-VDC system to control the operation of the outboard's electric motor (not shown). In addition, the controller 34 can also be configured to control actuation of the reverse hook assembly 10 based on input received from the switch 30. The switch 30 is wired to the controller 34 such that when the switch 30 is moved to the "reverse gear" position, the switch 30 triggers the controller 34 to output a voltage to the solenoid 18. Also, the switch 30 is wired to the controller 34 such that the voltage output to the solenoid 18 is removed once the switch 30 is moved from "reverse gear" to either "neutral" or "forward gear."

Figure 3B:
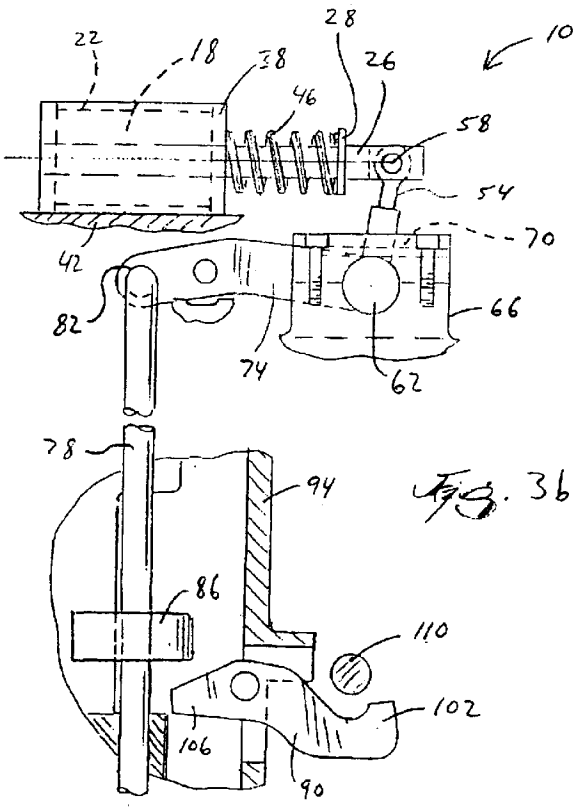
FIG. 3*b* is a partial cutaway side view of the outboard motor including the reverse hook assembly of FIG. 2, illustrating the assembly disengaged with the crossbar.
Figure 3A:
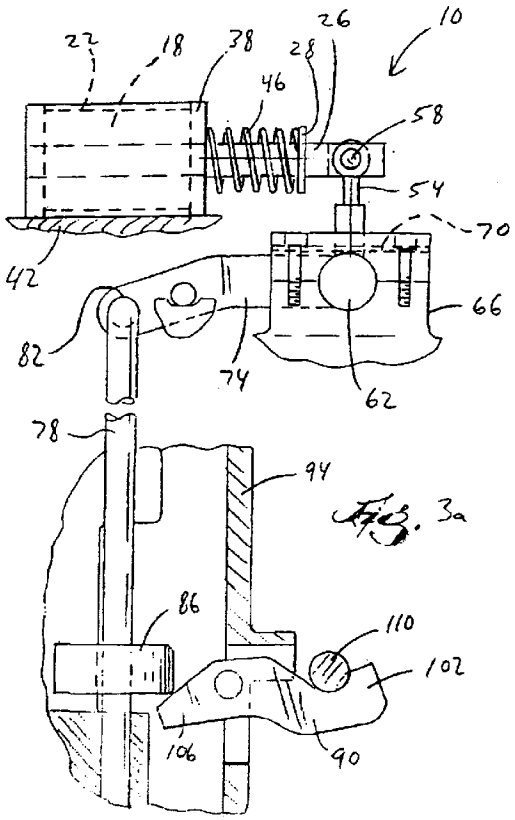
FIG. 3*a* is a partial cutaway side view of the outboard motor including the reverse hook assembly of FIG. 2, illustrating the assembly engaged with a crossbar.

As shown in FIGS. 3*a*–3*b*, the solenoid 18 is rigidly mounted to a bracket 38, which itself is rigidly mounted within the outboard housing 16 along with a majority of the components of the reverse hook assembly 10. In one configuration, the bracket 38 may be fastened to an interior boss 42 on the outboard housing 16. Alternatively, in another configuration, the bracket 38 may be integrally formed with a portion of the outboard housing 16. The plunger 26 is linearly movable relative to the body portion 22 of the solenoid 18 when voltage is applied to the solenoid 18. The solenoid 18 is configured to retract the plunger 26 into the body portion 22 upon the application of voltage. Alternatively, the solenoid 18 may be configured to extend the plunger 26 upon the application of voltage. A compression spring 46 held between a plunger stroke limiter 28 coupled to the plunger 26 and the bracket 38 to provide a biasing force against the plunger 26 upon retraction into the body portion 22, such that the spring 46 outwardly biases the plunger 26 from the body portion 22.

The plunger 26 includes a slot 50 to receive a first lever arm 54 therein, the combination of the slot 50 and first lever arm 54 forming a pinned joint 58 to allow the first lever arm 54 to pivot relative to the plunger 26. The first lever arm 54 is rigidly coupled to a shaft 62 which itself is coupled to the outboard housing 16 for pivoting thereon about a central axis 64. As shown in FIGS. 1 through 3*b*, the first lever arm 54 is fastened to the shaft 62. In another construction, the first lever arm 54 may be integrally formed with the shaft 62. The shaft 62 may be coupled to the outboard housing 16 for rotation relative to the housing 16 in a number of ways. As shown in FIGS. 3*a*–3*b*, the shaft 62 is snugly received between interior bosses 66 within the housing 16 and secured via a retaining plate 70. In another construction, the shaft 62 may be snugly received by a bushing coupled to the outboard housing 16 or to the bracket 38 securing the solenoid 18. Further, in another construction, the bushing may be integrally formed with the outboard housing 16.

A second lever arm 74 is rigidly coupled to the shaft 62 toward the opposite end of the shaft 62 as the first lever arm 54. The second lever arm 74 is positioned relative to the first lever arm 54 on the shaft 62 to achieve about 90-degrees of separation between the lever arms 54, 74. As shown in FIG. 2, the second lever arm 74 is integrally formed with the shaft 62. In another construction, the second lever arm 74 may be fastened to the shaft 62, similar to the first lever arm 54. The second lever arm 74 includes an aperture to receive a substantially vertically-extending rod 78 therethrough, forming a pivotal joint 82 allowing the rod 78 to pivot relative to the second lever arm 74. The rod 78 is slidably coupled to the outboard housing 16 within the interior of the outboard housing 16. The rod 78 may be coupled to the housing 16 in a number of different ways. In one construction, the rod 78 may be secured within the outboard housing 16 via integrally formed passageways that slidably receive the rod 78. In another construction, a bushing or multiple bushings may be coupled directly to the housing 16 or coupled to the housing 16 via brackets, whereby the rod 78 is slidably received by the bushing or multiple bushings. Further, in another construction, the bushing or multiple bushings may be integrally formed with the housing 16.

As shown in FIGS. 2–3*b*, a toe 86 is fixedly coupled to the rod 78 to provide a surface to engage a hook 90. The toe 86 defines a semi-circular shape, and is fixedly coupled to the rod 78 via a number of conventional ways, such as a setscrew connection, pin connection, welding, brazing, and so forth.

In one configuration of the reverse hook assembly 10 within an electric outboard 14, the outboard 14 includes a rotatable sleeve 94 attached to the housing 16. The sleeve 94 attaches to the housing 16 via a rotational element (not shown), such as a roller bearing or bushing, to allow the sleeve 94 to rotate relative to the housing 16. A non-rigid bracket 98 is coupled to the sleeve 94, whereby the non-rigid bracket 98 mounts the outboard 14 to a boat (not shown). When mounted to the boat, the sleeve 94 allows the outboard 14 to pivot relative to the boat.

As shown in FIGS. 3*a*–3*b*, the hook 90 is pivotally mounted to the sleeve 94. The hook 90 includes an outer portion 102 and an inner portion 106. The toe 86 engages the inner portion 106 of the hook 90 upon activation of the solenoid 18. In turn, the hook 90 pivots until engaging a fixed-location crossbar 110 positioned relative to the outer portion 102 of the hook 90. As shown in FIG. 1, the crossbar 110 is coupled to the bracket 98. Alternatively, the crossbar 110 may be directly coupled to the boat via fasteners or integrally forming with the boat. Also, instead of the crossbar 110, the hook 90 may engage another fixed member on the boat.

During operation, the operator moves the switch 30 to put the outboard 14 into reverse gear. The controller 34 receives the input from the switch 30, and outputs an initial voltage spike to the solenoid 18. The magnitude of the initial voltage spike is dependent on the available power and the operating specifications of the solenoid 18, however, about 48-VDC is a preferable initial voltage spike input to the solenoid 18. In the construction of FIGS. 1–3*b*, the plunger 26 retracts upon energizing the solenoid 18, therefore pivoting the first lever arm 54, the shaft 62, and the second lever arm 74.

The pivoting of the second lever arm 74 causes the rod 78 to move downward, therefore causing the toe 86 to engage the inner portion 106 of the hook 90. Its semi-circular shape allows the toe 86 to engage the inner portion 106 of the hook 90 along multiple positions adjacent the toe's outer perimeter. This is desirable since the toe 86 pivots with the motor housing 16 relative to the sleeve 94 and the hook 90 during steering of the boat. Therefore, the toe 86 is engageable with the inner portion 106 of the hook 90 at any steering position of the outboard 14.

The toe 86 pivots the hook 90 until the outer portion 102 of the hook 90 engages the crossbar 110. The motor controller 34 is preferably configured to reduce the voltage output to the solenoid 18 after the hook 90 engages the crossbar 110, since less voltage is required to maintain the plunger 26 in a retracted position. This helps conserve battery power, and also helps prevent the solenoid's coils from overheating due to receiving full power for an extended period of time. The controller 34 is preferably configured to reduce the voltage from the initial 48-VDC spike to a continuous 16-VDC after one second following the switch 30 being moved into reverse gear. Alternatively, this time interval can be changed to any reasonable length of time, or the controller 34 may interface with a sensor or multiple sensors to determine whether the hook 90 is engaged with the crossbar 110.

Upon moving the switch 30 from reverse gear into neutral or forward gear, the controller 34 receives the input from the switch 30 and removes the voltage output to the solenoid 18. The plunger 26 is then released toward its biased extended position, where the spring 46 provides a restoring force to the plunger 26 to assist in rotating the shaft 62, and subsequently retracting the rod 78. As the rod 78 retracts, the toe 86 disengages the inner portion 106 of the hook 90, allowing the outer portion 102 of the hook 90 to disengage the crossbar 110 by pivoting downward under its own weight. Alternatively, a torsion spring (not shown) may be incorporated at the hook's pivot to resiliently bias the outer portion 102 of the hook 90 away from the crossbar 110.

Figure 4:
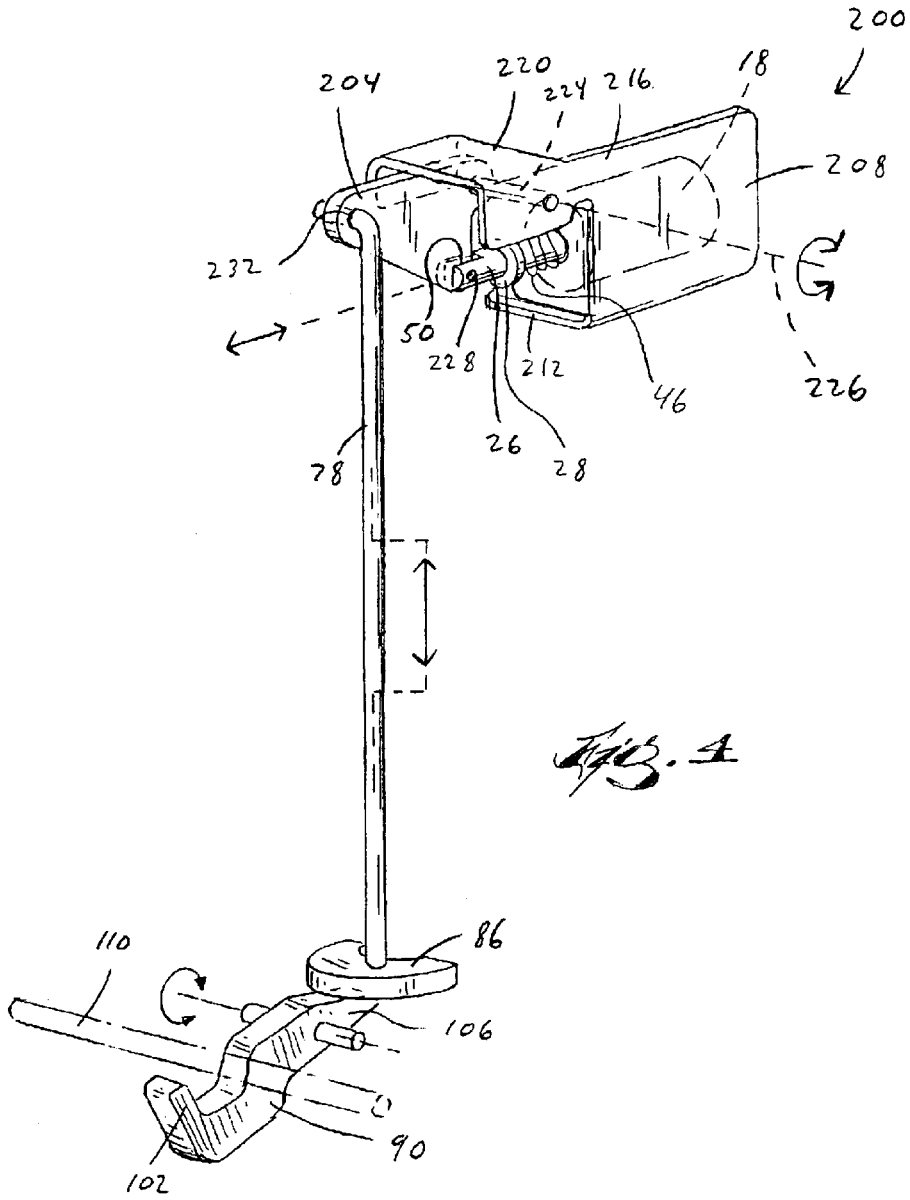
FIG. 4 is a perspective view of another construction of a reverse hook assembly embodying the present invention.
Figure 5B:
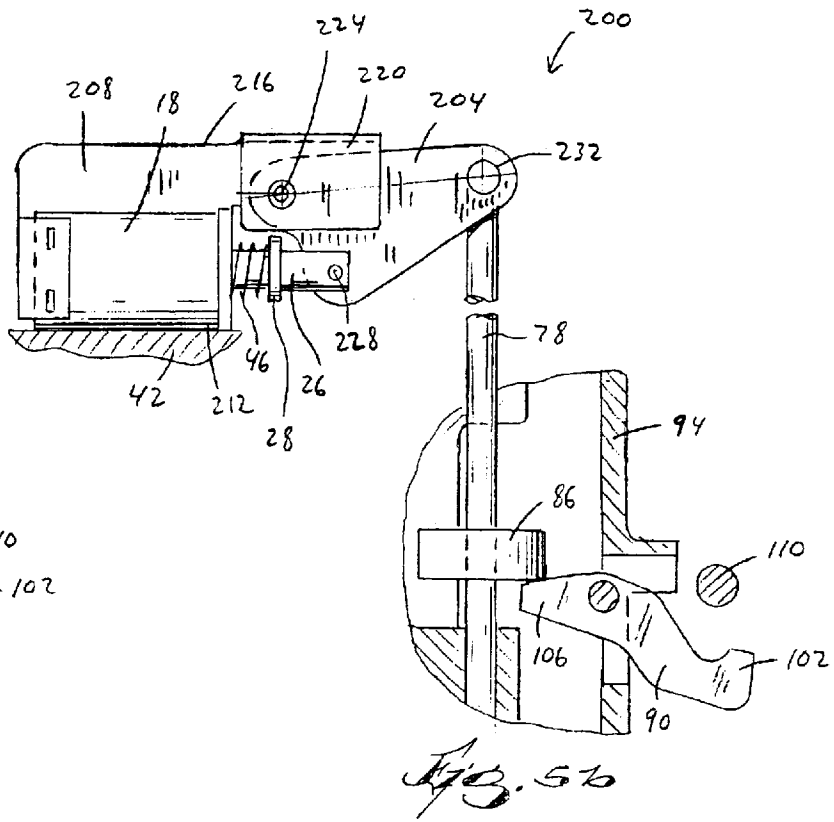
FIG. 5*b* is a partial cutaway side view of the outboard motor including the reverse hook assembly of FIG. 4, illustrating the assembly disengaged with the crossbar.

With reference to FIGS. 4–5*b*, another construction of a reverse hook assembly 200 is shown. The reverse hook assembly 200 utilizes a rigid plate in the form of a bell crank lever 204 rather than the shaft 62 illustrated in FIGS. 1–3*b* to translate the substantially horizontal motion of the plunger 26 to the substantially vertical motion of the rod 78. In the reverse hook assembly 200 of FIGS. 4–5*b*, like components are labeled with like reference numerals as those in the reverse hook assembly 10 of FIGS. 1–3*b*.

A bracket 208 is utilized to secure the solenoid 18 to the housing 16 of the outboard 14 (shown only in FIG. 1). In one configuration, the bracket 208 may be fastened to the interior boss 42 on the outboard housing 16. Alternatively, in another configuration, the bracket 208 may be integrally formed with a portion of the outboard housing 16. The bracket 208 includes a lower portion 212 and an upper portion 216. The lower portion 212 of the bracket 208 is fastened to the interior boss 42, while the upper portion 216 includes a lever mounting portion 220 positioned above the plunger 26. The bell crank lever 204 is pivotally coupled to the lever mounting portion 220 via a first pinned joint 224, such that the bell crank lever 204 is allowed to pivot about a central axis 226. Also, the slot 50 in the plunger 26 receives a portion of the bell crank lever 204 therein. A second pinned joint 228 between the slot 50 and the bell crank lever 204 allows the bell crank lever 204 to pivot relative to the plunger 26. Also, the bell crank lever 204 includes an aperture to receive the substantially vertically-extending rod 78 therethrough, forming a pivotal joint 232 allowing the rod 78 to pivot relative to the bell crank lever 204. The remaining structure of the reverse hook assembly 200 of FIGS. 4–5*b* is similar to that structure previously described in FIGS. 1–3*b*, and further description thereof is omitted.

Figure 5A:
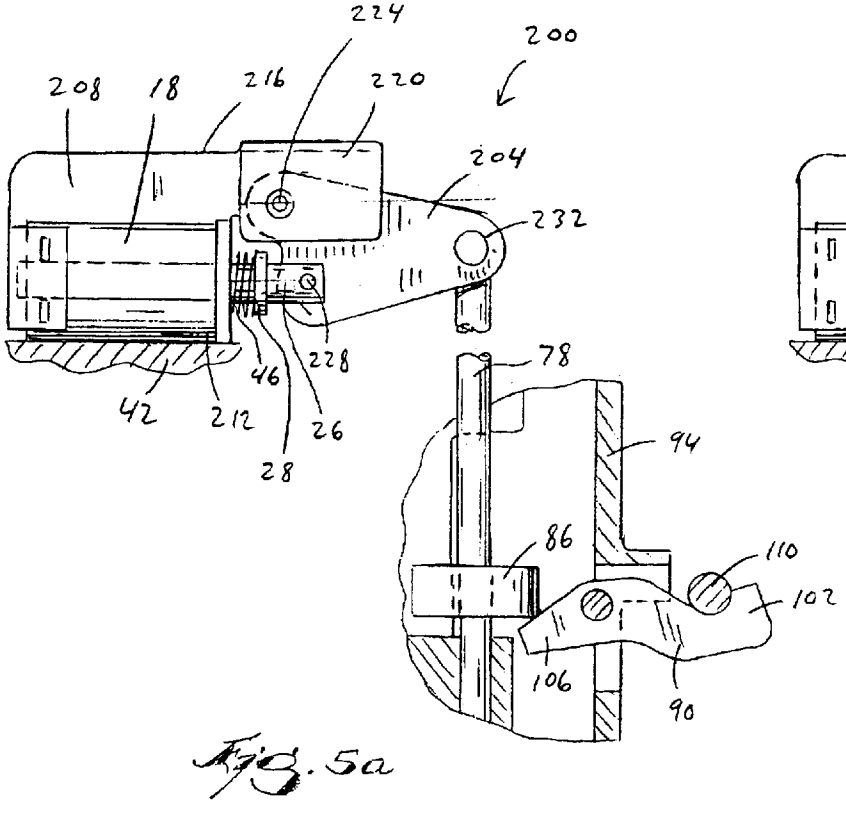
FIG. 5*a* is a partial cutaway side view of the outboard motor including the reverse hook assembly of FIG. 4, illustrating the assembly engaged with the crossbar.

Operation of the reverse hook assembly 200 of FIGS. 4–5*b* is substantially the same as the operation of the reverse hook assembly 10 of FIGS. 1–3*b*. The operator moves the switch 30 to put the outboard 14 into reverse gear. The controller 34 receives the input from the switch 30, and outputs an initial voltage spike to the solenoid 18. However, in the reverse hook assembly 200 of FIGS. 4–5*b*, the plunger 26 retracts upon energizing the solenoid 18, therefore pivoting the bell crank lever 204 in a clockwise direction (as illustrated in FIGS. 5*a*–5*b*) to move the rod 78 downwards. The remaining operational steps involving the interaction of the rod 78, toe 86, hook 90, and crossbar 110 are the same as previously described for the reverse hook assembly 10 of FIGS. 1–3*b*.

Also, upon moving the switch 30 from reverse gear into neutral or forward gear, the controller 34 receives the input from the switch 30 and removes the voltage output to the solenoid 18. The plunger 26 is then released toward its biased extended position, where the spring 46 provides a restoring force to the plunger 26 to assist in rotating the bell crank lever 204, and subsequently retracting the rod 78. The remaining operational steps involving the interaction of the rod 78, toe 86, hook 90, and crossbar 110 are the same as previously described for the reverse hook assembly 10 of FIGS. 1–3*b*.

In other configurations of the reverse hook assembly (not shown), the assembly 10 or 200 is integrated with a conventional, engine-powered outboard motor. In this configuration, the assembly 10 or 200 may utilize a separate and dedicated controller 34 to oversee operation of the assembly 10 or 200. Alternatively, the controller 34 may not be necessary, and the solenoid 18 is wired directly to a power source, such as battery, through the switch 30.

We claim:

1. A reverse hook assembly that is adapted to attach an outboard motor to a fixed member interconnected to a marine vessel, the reverse hook assembly comprising:

a movable hook engageable with the fixed member;

a solenoid having a movable plunger;

a linkage that selectively moves the hook in response to movement of the plunger, the linkage including a lever coupled to the plunger;

a rod responsive to movement of the lever; and a toe fixedly coupled to the rod to selectively engage the hook for pivotal movement; and a switch electrically connecting the solenoid with a power source.

2. The reverse hook assembly of claim 1, wherein the lever includes a rigid shaft being pivotable about a central axis;

a first lever arm extending from the shaft, the first lever arm being coupled to the plunger; and a second lever arm extending from the shaft, the second lever arm being coupled to the rod.

3. The reverse hook assembly of claim 2, wherein the second lever arm is angularly offset about the central axis from the first lever arm about 90 degrees.

4. The reverse hook assembly of claim 2, wherein the lever is a rigid plate including a first portion being pivotable about a central axis;

a second portion spaced from the first portion, the second portion being pivotally coupled to the plunger; and a third portion spaced from the first and second portions, the third portion being pivotally coupled to the rod.

5. The reverse hook assembly of claim 1, wherein movement of the plunger pivots the hook to engage and disengage the fixed member.

6. The reverse hook assembly of claim 1, wherein the hook is rotationally fixed relative to the fixed member, and wherein the toe includes a semi-circular shape to engage the hook.

7. The reverse hook assembly of claim 1, further comprising a spring resiliently biasing the linkage against movement caused by the plunger.

8. The reverse hook assembly of claim 1, further comprising a controller electrically connected between the switch and the solenoid, the controller supplying a voltage to the solenoid.

9. The reverse hook assembly of claim 8, wherein the controller supplies a first voltage to the solenoid to move the hook to a position engaging the fixed member.

10. The reverse hook assembly of claim 9, wherein the controller supplies a second voltage that is lower than the first voltage to maintain the hook in the position engaging the fixed member.

11. The reverse hook assembly of claim 1, wherein the fixed member is a crossbar.

12. The reverse hook assembly of claim 1, wherein the solenoid is positioned inside a housing of the outboard motor.

13. The reverse hook assembly of claim 1, wherein the switch is interconnected with a housing of the outboard motor.

14. The reverse hook assembly of claim 1, wherein the linkage is positioned inside the outboard motor.

15. A reverse hook assembly that is adapted to attach an outboard motor to a fixed member interconnected to a marine vessel, the reverse hook assembly comprising:

a movable hook engageable with the fixed member;

a solenoid having a movable plunger;

a lever coupled to the plunger;

a rod that selectively causes the hook to move in response to movement of the lever; and a switch electrically connecting the solenoid with a power source;

wherein the lever includes a rigid shaft being pivotable about a central axis;

a first lever arm extending from the shaft, the first lever arm being coupled to the plunger; and a second lever arm extending from the shaft, the second lever arm being coupled to the rod.

16. The reverse hook assembly of claim 15, wherein the second lever arm is angularly offset about the central axis from the first lever arm about 90 degrees.

17. A reverse hook assembly that is adapted to attach an outboard motor to a fixed member interconnected to a marine vessel, the reverse hook assembly comprising:

a movable hook engageable with the fixed member;

a solenoid having a movable plunger;

a lever coupled to the plunger;

a rod that selectively causes the hook to move in response to movement of the lever; and a switch electrically connecting the solenoid with a power source;

wherein the lever is a rigid plate including a first portion being pivotable about a central axis;

a second portion spaced from the first portion, the second portion being pivotally coupled to the plunger; and a third portion spaced from the first and second portions, the third portion being pivotally coupled to the rod.

18. A reverse hook assembly that is adapted to attach an outboard motor to a fixed member interconnected to a marine vessel, the reverse hook assembly comprising:

a movable hook engageable with the fixed member;

a solenoid having a movable plunger;

a lever coupled to the plunger;

a rod that selectively causes the hook to move in response to movement of the lever; and a switch electrically connecting the solenoid with a power source;

wherein the rod includes a toe fixedly coupled thereon, wherein movement of the plunger results in movement of the toe, and wherein the toe pivots the hook to engage and disengage the fixed member.

19. The reverse hook assembly of claim 18, further comprising a bracket adapted to mount the outboard motor on the marine vessel, wherein the fixed member is coupled to the bracket.

20. The reverse hook assembly of claim 19, the motor including a motor housing having a rotatable portion, wherein the bracket is coupled to the rotatable portion to allow the motor to pivot relative to the marine vessel, and wherein the hook is pivotally coupled to the rotatable portion.

21. The reverse hook assembly of claim 20, wherein the rod is within the rotatable portion, and wherein the hook is at least partially within the rotatable portion.

22. The reverse hook assembly of claim 18, wherein the hook is rotationally fixed relative to the fixed member, and wherein the toe includes a semi-circular shape to engage the hook at a location adjacent an outer perimeter of the toe.

23. The reverse hook assembly of claim 18, further comprising a spring resiliently biasing the lever against movement caused by the plunger.

24. The reverse hook assembly of claim 18, further comprising a controller electrically connected between the switch and the solenoid, the controller supplying a voltage to the solenoid.

25. The reverse hook assembly of claim 24, wherein the controller supplies a first voltage to the solenoid for a timed interval.

26. The reverse hook assembly of claim 25, wherein the controller supplies a second voltage following the timed interval, the second voltage being less than the first voltage.

27. A method of actuating a reverse hook assembly for an outboard motor, the method comprising:

manipulating a switch to a first position;

applying a first voltage to a solenoid to initiate movement of the hook assembly;

replacing the first voltage with a second voltage to the solenoid to maintain the hook assembly in an engaged position, the second voltage being less than the first voltage;

manipulating the switch to a second position; and removing the second voltage from the solenoid to initiate movement of the hook assembly toward a disengaged position.

* * * * *